US012471659B2

(12) United States Patent
Jang

(10) Patent No.: US 12,471,659 B2
(45) Date of Patent: Nov. 18, 2025

(54) SHOE STRUCTURE FOR GROUND EARTHING AND STATIC ELECTRICITY EMISSION

(71) Applicant: Yoon Seop Jang, Jeollanam-do (KR)

(72) Inventor: Yoon Seop Jang, Jeollanam-do (KR)

( * ) Notice: Subject to any disclaimer, the term of this patent is extended or adjusted under 35 U.S.C. 154(b) by 152 days.

(21) Appl. No.: 18/689,165

(22) PCT Filed: Jun. 17, 2022

(86) PCT No.: PCT/KR2022/008592

§ 371 (c)(1),
(2) Date: Mar. 5, 2024

(87) PCT Pub. No.: WO2023/038239

PCT Pub. Date: Mar. 16, 2023

(65) Prior Publication Data

US 2025/0127260 A1 Apr. 24, 2025

(30) Foreign Application Priority Data

Sep. 10, 2021 (KR) ..... 10-2021-0121327

(51) Int. Cl.
*A43B 7/36* (2006.01)
*A43B 13/38* (2006.01)

(52) U.S. Cl.
CPC ..... *A43B 7/36* (2013.01); *A43B 13/386* (2013.01)

(58) Field of Classification Search
CPC ..... A43B 7/36; A43B 13/38; A43B 13/386
USPC ..... 361/223
See application file for complete search history.

(56) References Cited

U.S. PATENT DOCUMENTS 4,249,226 A * 2/1981 Westberg ..... A61N 1/14 361/223
2020/0323306 A1* 10/2020 Ioannou ..... B32B 7/06

FOREIGN PATENT DOCUMENTS

CN 202999485 U 6/2013
CN 210018057 U 2/2020
KR 200320706 Y1 * 7/2003 ..... A43B 7/36
KR 20-0414436 Y1 4/2006
KR 20100136574 A * 12/2010 ..... A43B 7/36

(Continued)

OTHER PUBLICATIONS

Machine translation of Heo Korean Patent Document KR 20-0320706 Y1 Jul. 2003 (Year: 2003).*

(Continued)

*Primary Examiner* — Kevin J Comber
(74) *Attorney, Agent, or Firm* — KORUS Patent, LLC; Seong Il Jeong

(57) ABSTRACT

Provided is a shoe structure for earth ground and static electricity discharge, which includes a shoe and an inner sole provided inside the shoe, and the inner sole includes: a base plate; a foot contact plate which is adhered to the upper surface of the base plate, and is made of a copper plate; a conduction unit which extends from both sides or the rear of the foot contact plate, and is exposed above an ankle support unit in order to allow a ground unit to be connected; and a ground unit which is connected so as to be electrically connected to the conduction unit, and is adapted to be grounded on the ground, and a structure capable of charging earth energy through an earthing, and discharging static electricity generated inside and outside the human body rapidly and completely to the outside of the body.

3 Claims, 9 Drawing Sheets

(56) References Cited

FOREIGN PATENT DOCUMENTS

| | | | | | |
|---|---|---|---|---|---|
| KR | 10-1958352 | B1 | | 3/2019 | |
| WO | WO-2009091236 | A1 | * | 7/2009 | ..... A43B 3/163 |
| WO | WO-2010101452 | A1 | * | 9/2010 | ..... A43B 3/163 |

OTHER PUBLICATIONS

Machine translation of Park Korean Patent Document KR 10-2010-0136574 A Dec. 2010 (Year: 2010).*

* cited by examiner

SHOE STRUCTURE FOR GROUND EARTHING AND STATIC ELECTRICITY EMISSION

TECHNICAL FIELD

The present invention relates to a shoe structure for ground engagement and the static electricity discharge, and more particularly, to a shoe structure for maintaining health by charging the energy of the earth through an earthing and discharging (grounding) static electricity generated inside and outside the body through the earth.

BACKGROUND ART

The term "earthing" means that the body is electrically connected through contact with the earth, that is, the ground (surface of the earth), to maintain health by charging the earth's energy, and is a kind of alternative medicine for treating inflammation and pain as well as preventing diseases in recent years.

The pioneer of Earthing is Clinton Over in the United States, which started with the question that humans may not maintain their health because they are disconnected from natural electrical charges on the surface due to shoes that have been outfitted with plastic or rubber for a long time, and has since been proven to be true through scientific research by many researchers including biophysics, electrophysiologists, doctors, and exercise physiologists.

The world is paying attention to the effects of "Earthing" on the human body, as the effects of Earthing were presented at the 53rd Autumn Conference at the Korea Analytical Science Society as well as overseas, under the theme of "The Human Effects and Earthing Effects of Electromagnetic Waves."

In addition, the static electricity is a phenomenon in which an object obtained as electrons move has a negative charge and an object that has lost electrons has a positive charge, which is called an electrification phenomenon. The static electricity is generated when two or more insulators rub against each other, and even in the inside of a human body, while blood circulates throughout the body at a high speed, static electricity may be generated by friction between red blood cells and blood vessels, and between red blood cells and red blood cells.

In addition, static electricity is generated in the tissues of blood vessels, lymphatic vessels, red blood cells, and lymph isocycles in which blood and lymph flow in the human body, static electricity is generated in the tissues of the digestive system in which food is received, and static electricity is also generated in the tissues of the lungs and bronchi of the respiratory system in which air is introduced and discharged through breathing.

As such, human static electricity generated inside the human body accumulates in fat cells or cell membranes with high electrical resistance, and accumulated human static electricity causes discharge to damage nerve cells. Therefore, if static electricity accumulated in the body is not discharged out of the body, it may cause a disease, so it should be discharged out of the body as quickly and completely as possible.

The ground is a very important means for allowing static electricity charged to an object to flow to the earth, and in the case of static electricity, the ground should be provided in a case of a Conductive & Dissipative having a specific resistance of 108 [Ω·m] or less.

In general, the contact with the ground by using a conductor is referred to as the ground (earth), and in order to provide the earthing and discharge of static electricity to the human body, it is preferable that a ground means is formed on an insole supporting the sole of the foot.

DISCLOSURE

Technical Problem

The purpose of the present invention is to provide a shoe for maintaining health by being able to charge the energy of the earth through earthing and to discharge static electricity generated inside and outside the human body quickly and completely out of the body.

Technical Solution

To achieve the above aim, according to one embodiment of the present invention, a shoe structure for earth ground and the discharge of static electricity comprises a shoe and an insole built into the shoe and having a earth ground and a static electricity discharge means, wherein the insole comprises a base plate, a foot contact plate which is adhered to the top surface of the base plate and made of a copper plate, a conduction unit which is extended from both sides or the rear of the foot contact plate and is exposed above an ankle support unit so as to enable a grounding unit to be connected, and a grounding unit which is electrically connected to the conduction unit and is grounded on the earth.

According to one embodiment of the present invention, the conduction unit comprises: an extension unit extending from both side surfaces of a foot contact plate or from the rear side thereof; a bent unit extending from the extension unit and mounted on an ankle support unit of a shoe; and a ground connection unit extending from the bent unit and formed vertically downward.

According to one embodiment of the present invention, the extension unit, the bent unit, and the ground connection unit comprise a copper plate, wherein a coating plate is adhered to one side surface of the copper plate so as to protect the copper plate.

According to an embodiment of the present invention, the grounding unit comprises a copper plate and a coated plate attached to one side of the copper plate, wherein the copper plate of the grounding unit is in close contact with the copper plate of the grounding connection unit to be coupled by a coupling means, and the lower end of the grounding unit is configured to form a folded or rolled earth grounding unit such that the copper plate is in contact with the earth.

According to an embodiment of the present invention, the grounding unit is made of a metal chain and is configured to be connected to the ground connection unit as a feature.

Advantageous Effects

As described above, the present invention provides a structure capable of charging earth energy through earthing and quickly and completely discharging static electricity generated inside and outside the human body to the outside of the human body, thereby keeping the human body healthy.

MODE FOR INVENTION

Figure 1:
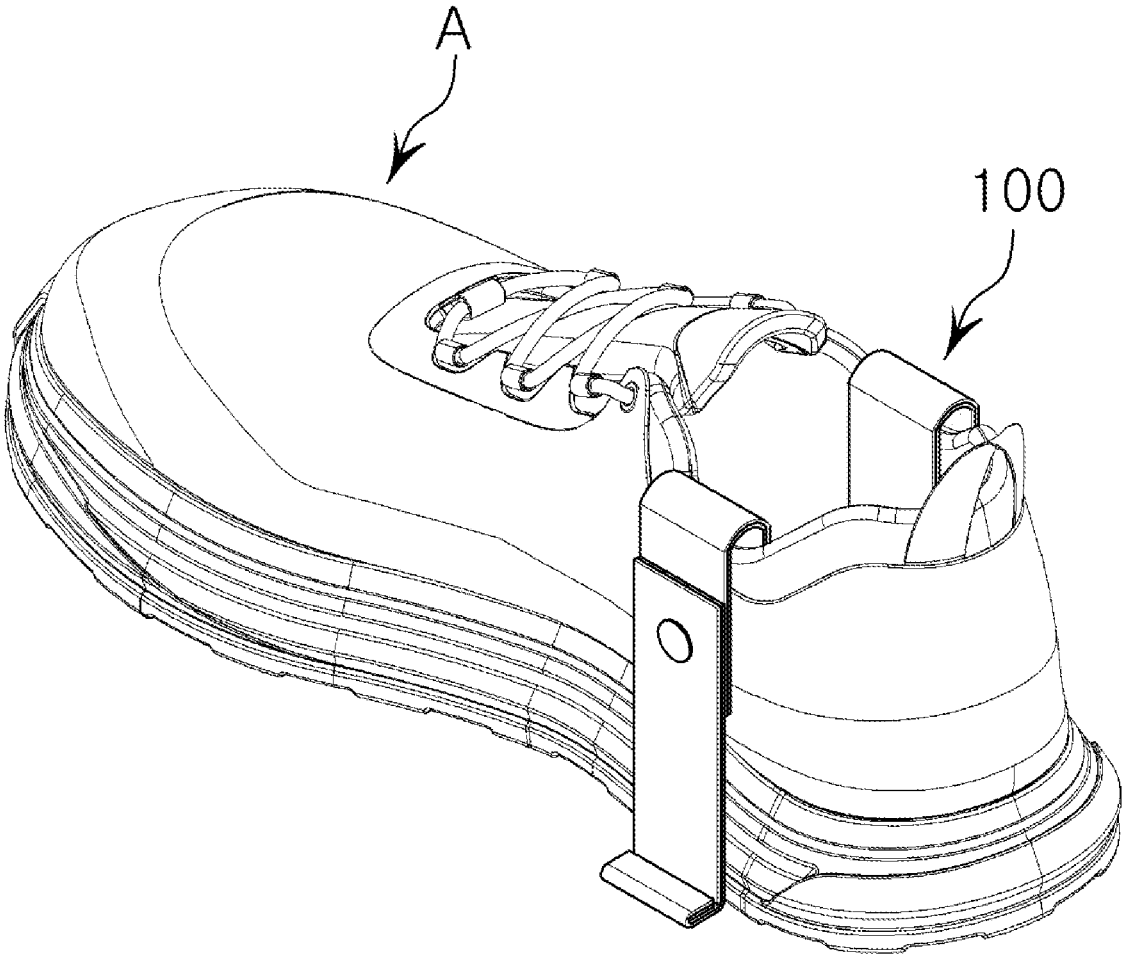
FIG. 1 is a perspective view of a shoe of the present invention.

Hereinafter, embodiments of the present invention will be described in detail with reference to the accompanying drawings so that those skilled in the art to which the present invention pertains may easily implement the embodiments. However, the present invention may be implemented in various different forms and is not limited to the embodiments described herein. The terminology used herein is for the purpose of describing particular embodiments only and is not intended to be limiting of the present invention. In addition, the singular forms used here include a plurality of forms unless the phrases clearly indicate the opposite meaning. As used herein, the term "including" means specifying a specific characteristic, region, integer, step, operation, element, and/or component, and does not exclude the presence or addition of another specific characteristic, region, integer, step, operation, element, component, and/or group. Although not differently defined, all terms including technical terms and scientific terms used herein have the same meanings as those generally understood by those skilled in the art to which the present invention pertains. Terms defined in commonly used dictionaries are additionally interpreted as having meanings corresponding to the relevant technical documents and the currently disclosed contents, and are not interpreted as ideal or official meanings unless defined.

Embodiments of the present invention described with reference to a perspective view specifically represent ideal embodiments of the present invention. As a result, various variations of the illustration are expected, for example variations in manufacturing methods and/or specifications. Therefore, the embodiments are not limited to a specific form of the illustrated region, and include, for example, a modification of a form by manufacturing. For example, an area shown or described as flat may have characteristics that are generally rough/rough and nonlinear. Further, a part shown as having a sharp angle may be rounded. Therefore, the regions illustrated in the drawings are merely schematic, and the shapes thereof are not intended to illustrate an accurate shape of the region, and are not intended to narrow the scope of the present invention.

Hereinafter, preferred embodiments of a shoe structure for earth ground and electrostatic discharge according to the present invention will be described in detail with reference to the accompanying drawings.

Example of the Invention

Figure 2:
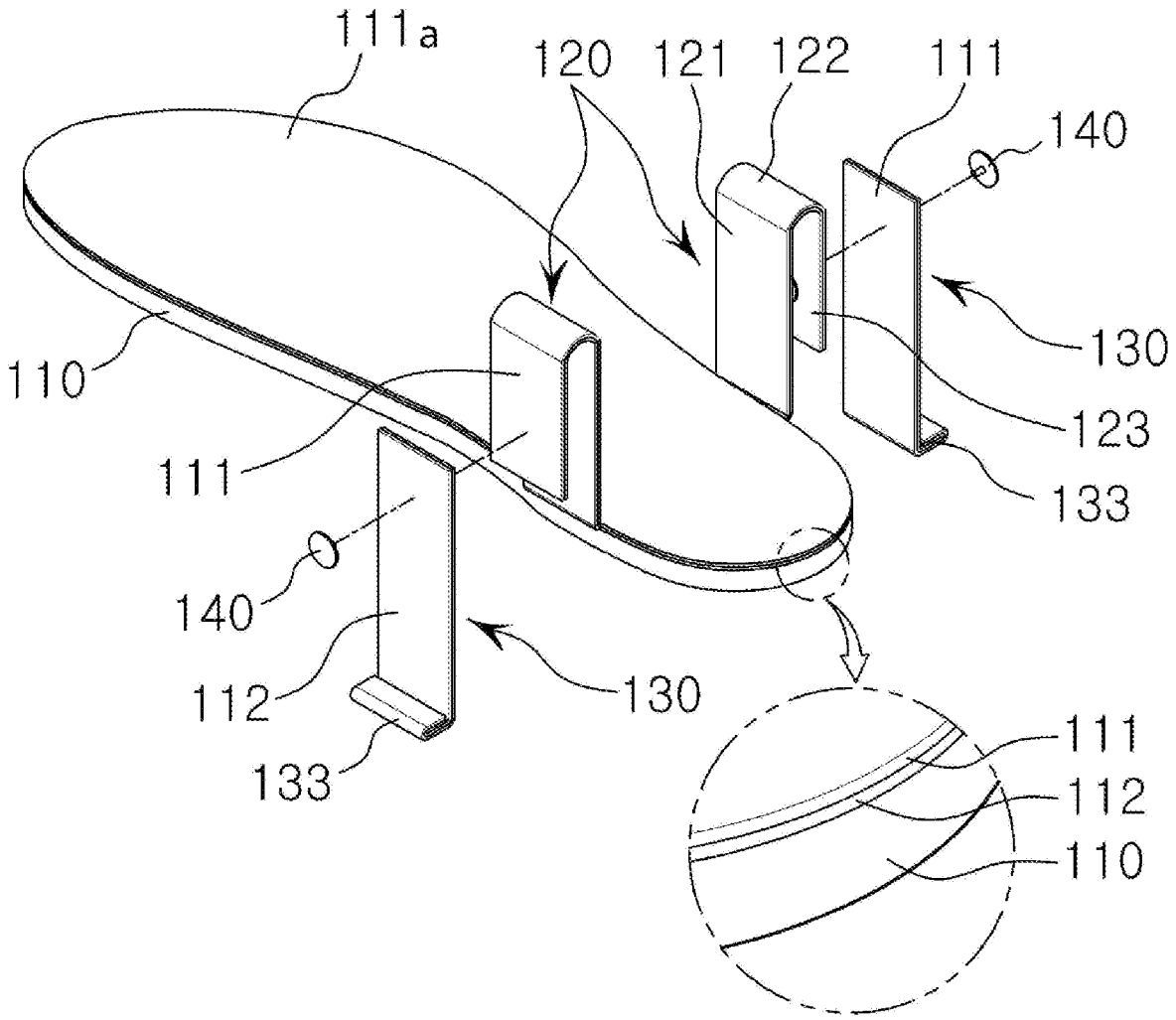
FIG. 2 is an exploded perspective view for showing a funnel plate structure built in the shoe of the present invention.
Figure 3:
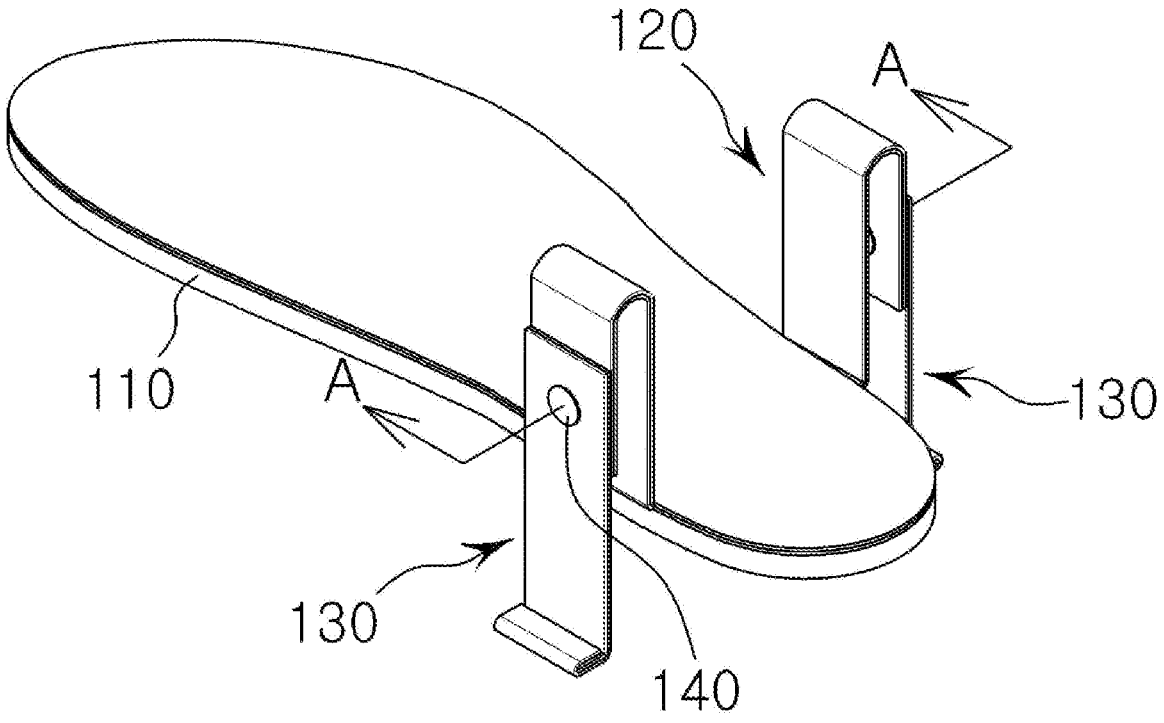
FIG. 3 is a combined perspective view for showing a funnel plate structure built in the shoe of the present invention.
Figure 4:
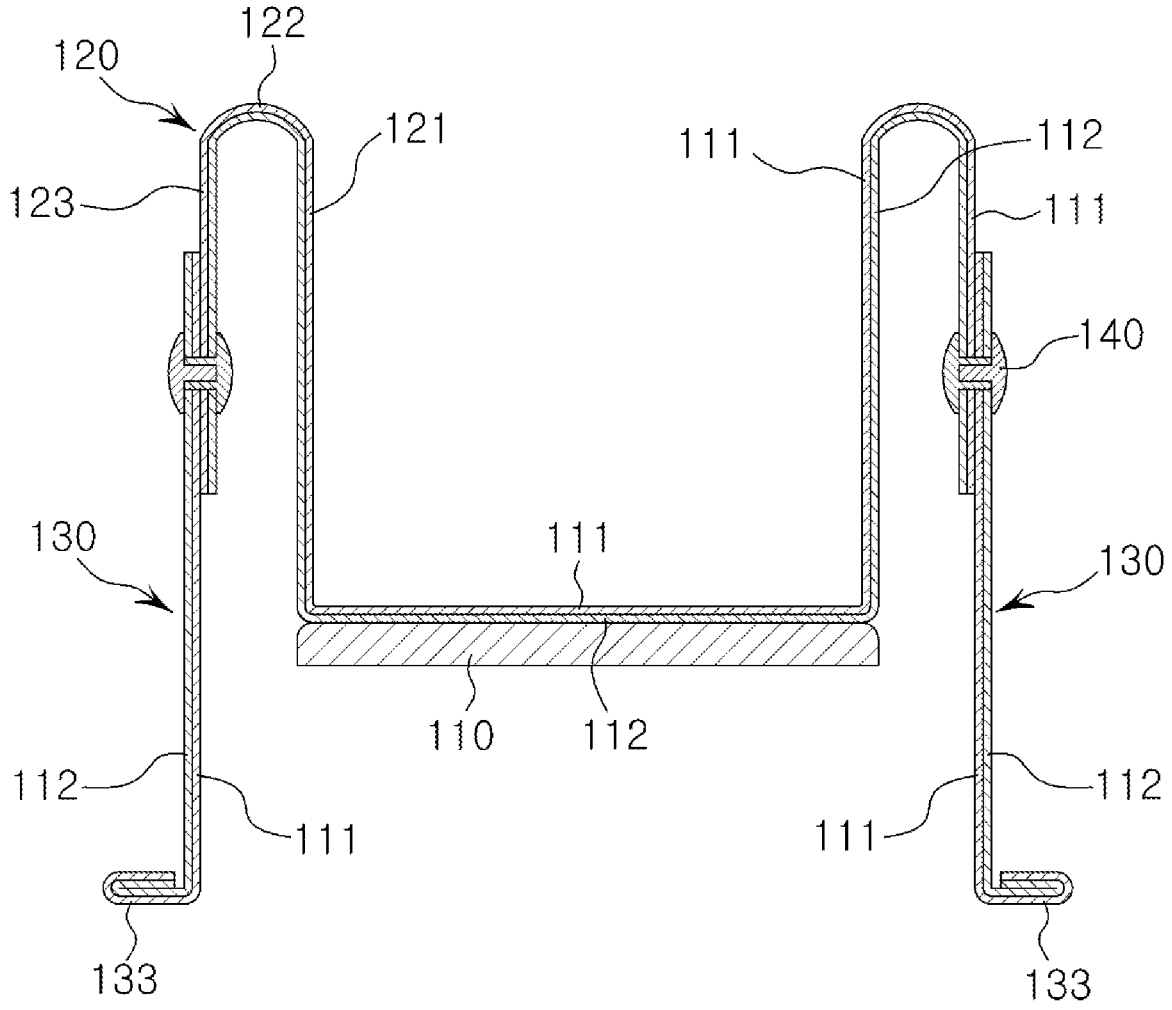
FIG. 4 is a cross-sectional view taken along line A-A of FIG. 3.
Figure 5:
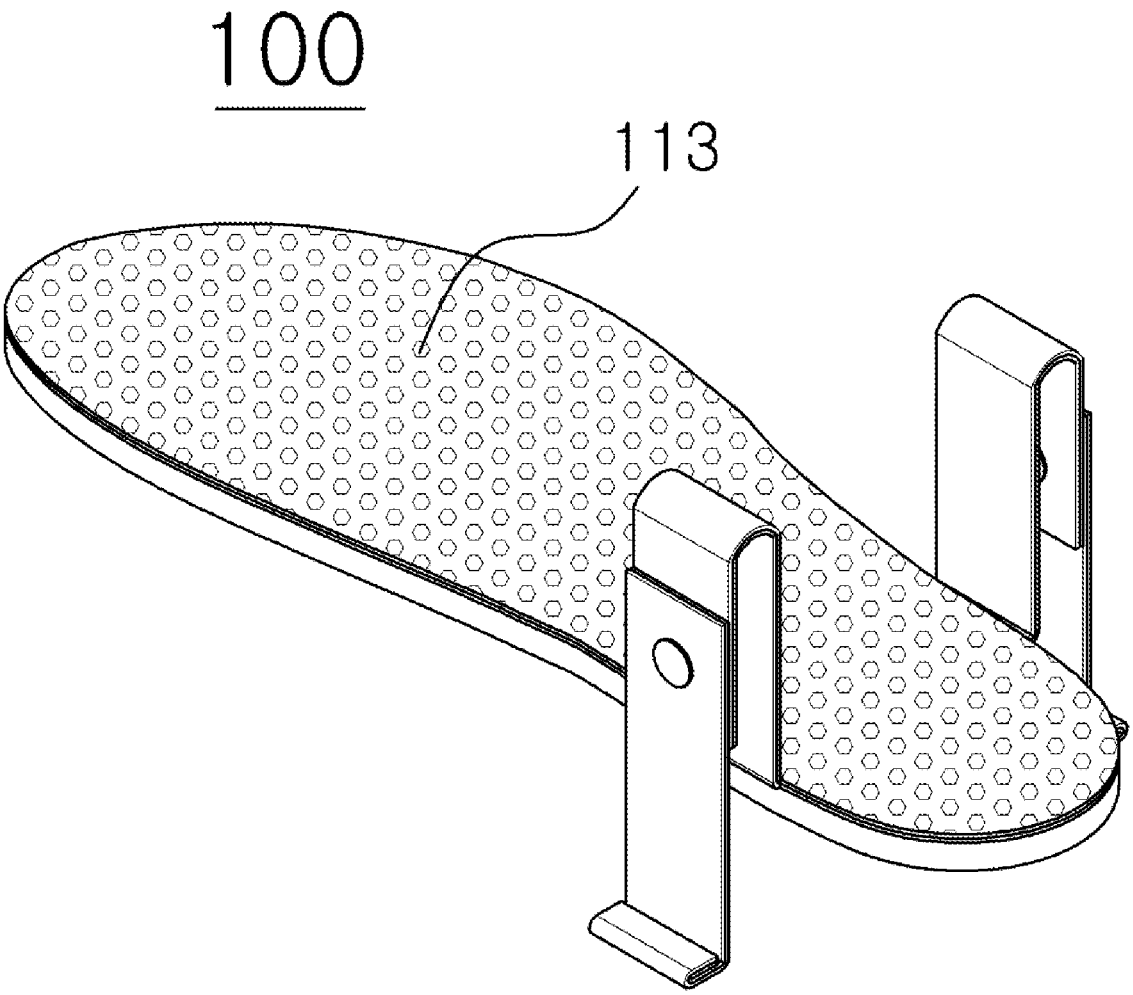
FIG. 5 is a reference view for showing another embodiment of a footplate embedded in the shoe of the present invention.
Figure 6:
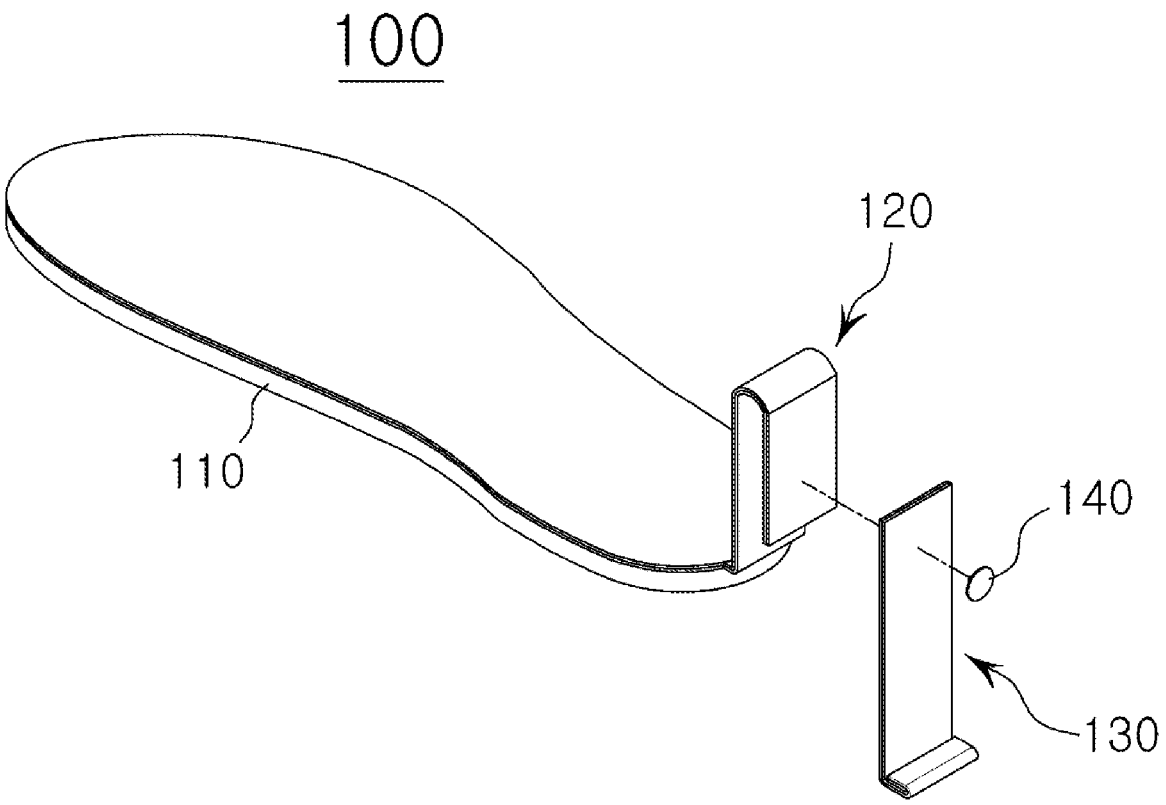
FIG. 6 is a reference view for showing another embodiment of a footplate embedded in the shoe of the present invention.
Figure 7:
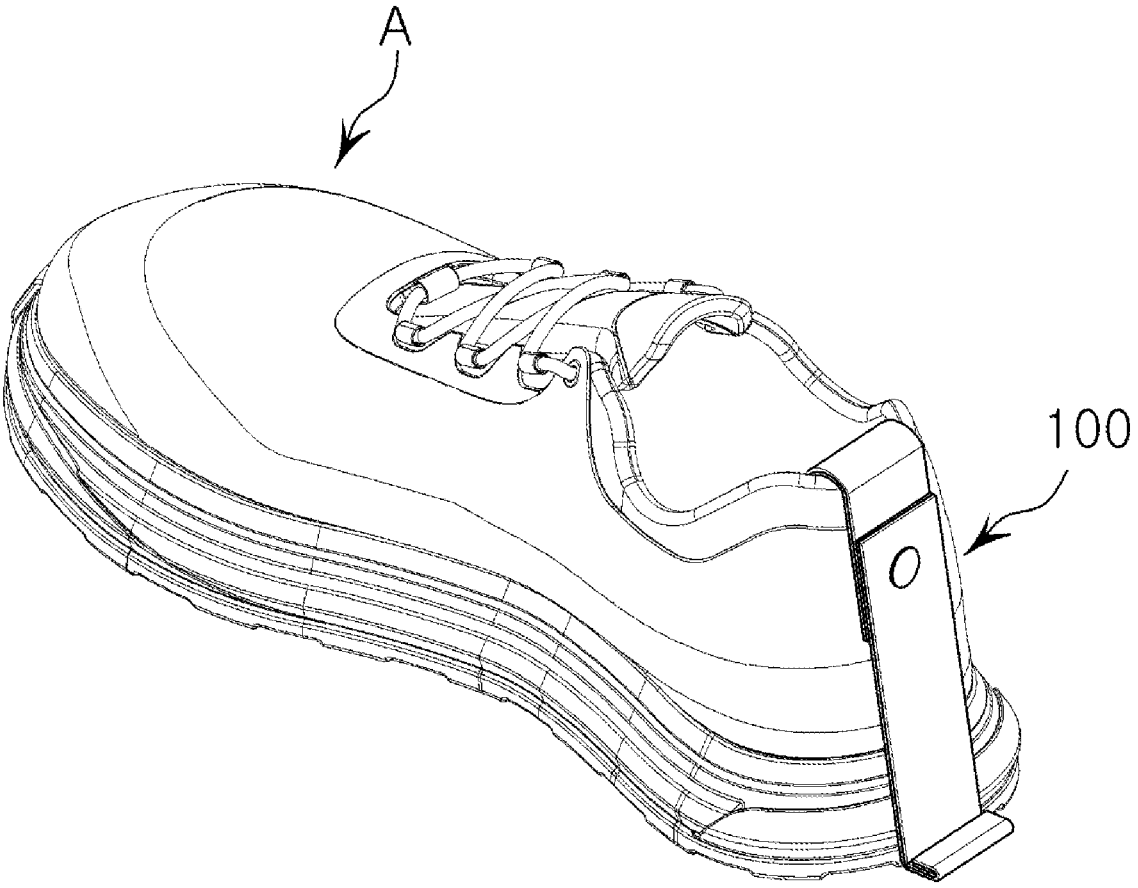
FIG. 7 is a reference view of a use state of FIG. 6.
Figure 8:
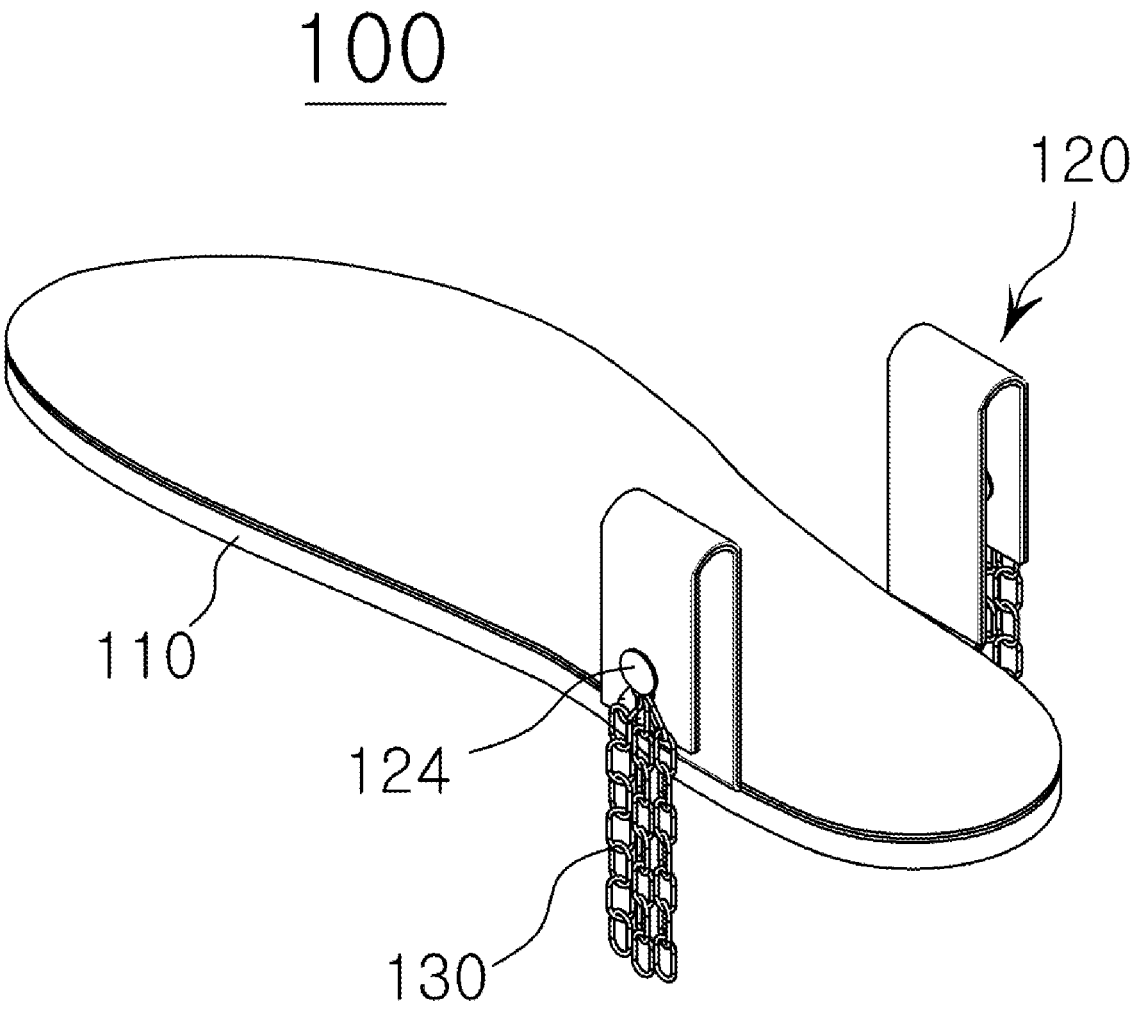
FIG. 8 is a reference view for showing another embodiment of a footplate embedded in the shoe of the present invention.
Figure 9:
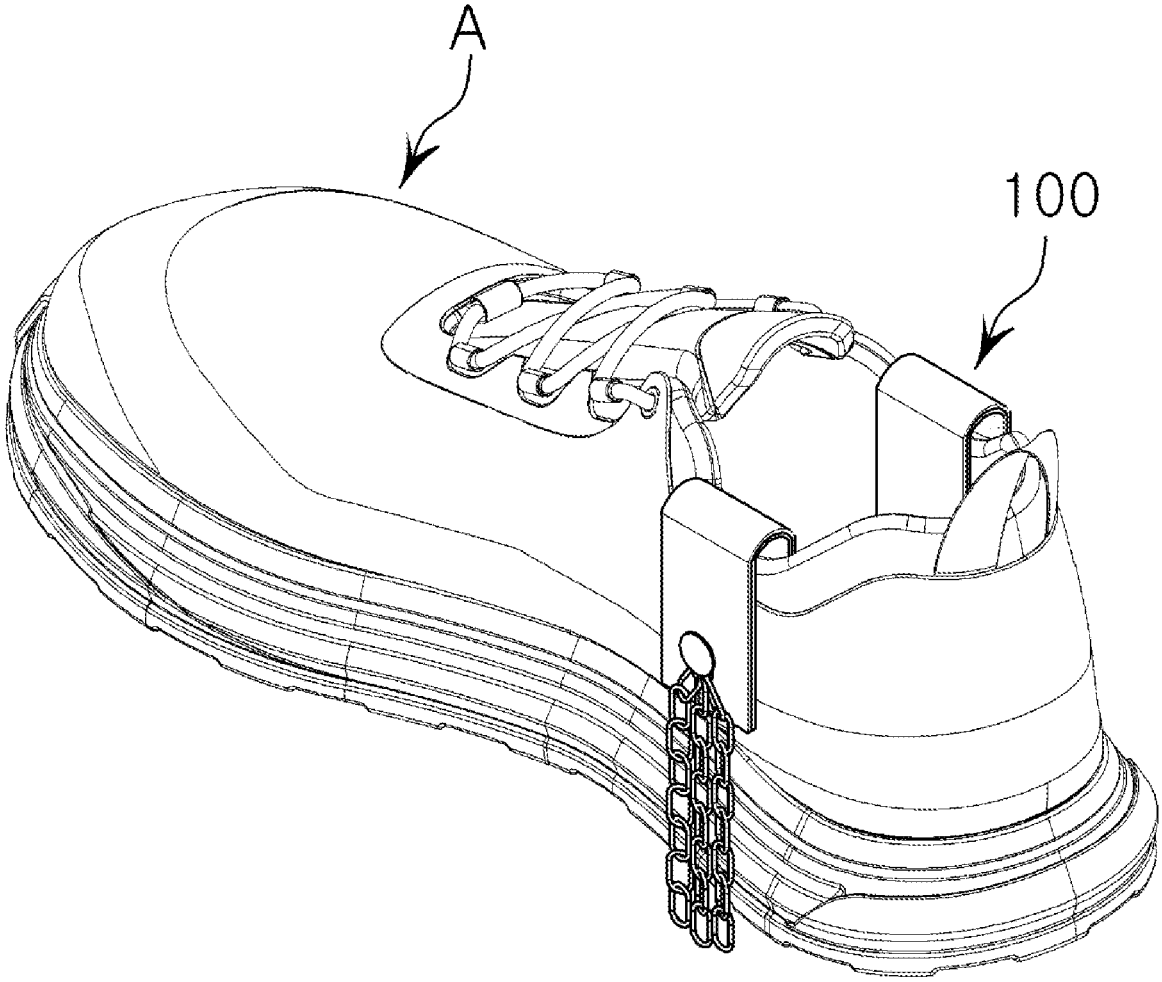
FIG. 9 is a reference view of a use state of FIG. 8.

FIG. 1 is a perspective view of a shoe of the present invention, FIG. 2 is an exploded perspective view for showing a structure of a funnel embedded in the shoe of the present invention, FIG. 3 is a coupled perspective view for showing a structure of a funnel embedded in the shoe of the present invention, FIG. 4 is a cross-sectional view taken along line A-A of FIG. 3, FIG. 5 is a reference view for showing another embodiment of a funnel embedded in the shoe of the present invention, FIG. 6 is a reference view for showing another embodiment of a funnel embedded in the shoe of the present invention, FIG. 7 is a reference view for a use state of FIG. 6, FIG. 8 is a reference view for showing another embodiment of a funnel embedded in the shoe of the present invention, and FIG. 9 is a reference view for a use state of FIG. 8.

First, it should be noted that in the drawings, the same components or parts are denoted by the same reference numerals as possible. In addition, in describing the present invention, a detailed description of related known functions or features will be omitted so as not to obscure the gist of the present invention.

The shoe structure according to the present invention comprises: a shoe (A); and an insole (100) built into the shoe, and which has a earth ground and a static-electricity-emitting means.

In this case, the insole 100 includes a foot-shaped funnel plate 110, a foot contact plate 111*a* adhered to an upper surface of the funnel plate 110, a conduction unit 120 extending from both side surfaces or a rear side of the foot contact plate 111*a* to be exposed above the ankle support unit to allow the grounding unit 130 to be connected thereto, and a grounding unit 130 electrically connected to the conduction unit 120 to be grounded to the earth.

The conduction unit 120 includes an extension unit 121 extending from both sides or the rear of the foot contact plate 111*a*, a bent unit 122 extending from the extension unit 121 and placed on the ankle support unit of the shoe A, and a ground connection unit 123 extending from the bent unit 122 and vertically formed downward.

The extension unit (121), the bent unit (122), and the ground connection unit (123) are made of copper plate (111) having good conductivity, and a covering plate (112) is adhered to one side of the copper plate (111) to protect the copper plate (111), wherein the covering plate (112) is preferably made of a tough and flexible natural material or synthetic resin plate material to prevent the thin copper plate from being torn or damaged.

The grounding unit (130) includes a copper plate (111) and a coated plate (112) attached to one side of the copper plate (111), wherein the copper plate (111) of the grounding unit (130) is coupled to the copper plate (111) of the ground connection unit (123) by a coupling means in a close contact manner. In this case, the coupling means is preferably the rivet 140, but a known fastening means such as a bolt and a nut may be used.

In the present invention, the copper plate 111 of the grounding unit 130 is not limited to the structure as long as it can tightly couple the copper plate 111 of the ground connection unit.

The lower end of the grounding unit 130 is configured to have a grounding unit 133 folded or rolled so that the copper plate 111 is configured to be in contact with the earth in order to easily discharge static electricity to the earth.

The grounding unit 130 is made of a metal chain and is connected to the ground connection unit 123, and for this, it is preferable that the ground connection unit 123 is perforated with a through hole 124.

In addition, it is natural that conductors of various shapes and structures may be replaced instead of the metal chain.

As described above, although the present invention has been described by limited embodiments, the present invention is not limited thereto, and various modifications and changes may be made by a person having ordinary skill in the art to which the present invention belongs within the equivalent range of the technical spirit of the present invention and the appended claims to be described below.

The invention claimed is:

1. A shoe structure for earth ground and static-electricity discharge, comprising:

a shoe; and an insole built in the shoe, wherein the insole comprises:

a funnel plate; a foot-contact plate adhered to an upper surface of the funnel plate, and made of a copper plate; a conduction part extending from both sides or a rear side of the foot-contact plate to be exposed above an ankle support part so that a grounding unit is connected to the conduction part; and the grounding unit electrically connected to the conduction part is grounded;

wherein the conduction part comprises: an extension unit extending from both side surfaces or the rear side of the foot-contact plate; a bent unit extending from the extension unit and placed on the ankle support part of the shoe; and a ground connection unit extending from the bent unit and vertically formed downward, and wherein each of the extension unit, the bent unit, and the ground connection unit are made of a copper plate, and a cover plate is bonded to one side surface of each copper plate of the extension unit, the bent unit, and the ground connection unit in order to protect each copper plate.

2. The shoe structure for earth ground and static-electricity discharge of claim 1, wherein the grounding unit comprises a copper plate and a cover plate attached to one side of the copper plate of the grounding unit, wherein the copper plate of the grounding unit is in contact with the copper plate of the ground connection unit, and a lower end of the grounding unit is configured such that the copper plate of the grounding unit is in contact with earth ground by forming a folded or rolled earth ground unit.

3. The shoe structure for earth ground and static-electricity discharge of claim 1, wherein the grounding unit is made of a metal chain and is configured to be connected to the ground connection unit.

* * * * *